United States Patent [19]

Hameyer et al.

[11] 4,169,102

[45] Sep. 25, 1979

[54] PROCESS FOR THE MANUFACTURE OF PARTIALLY NEUTRALIZED MIXED ESTERS OF LACTIC ACID, CITRIC ACID AND PARTIAL GLYCERIDES OF FATTY ACIDS

[75] Inventors: Peter Hameyer; Theodor Tomczak, both of Essen, Fed. Rep. of Germany

[73] Assignee: Th. Goldschmidt AG, Essen, Fed. Rep. of Germany

[21] Appl. No.: 923,987

[22] Filed: Jul. 12, 1978

[30] Foreign Application Priority Data

Jul. 28, 1977 [DE] Fed. Rep. of Germany ..... 2734059

[51] Int. Cl.[2] ..... C11C 3/02

[52] U.S. Cl. ..... 260/410.8; 260/410.7; 426/611

[58] Field of Search ..... 260/410.7, 410.8; 426/611

[56] References Cited

U.S. PATENT DOCUMENTS

| | | | |
|---|---|---|---|
| 2,978,329 | 4/1961 | Cochran | 260/410.8 |
| 3,173,796 | 3/1965 | Pader | 260/410.8 |

*Primary Examiner*—John Niebling

*Attorney, Agent, or Firm*—Toren, McGeady and Stanger

[57] ABSTRACT

A method for the manufacture of mixed esters of lactic acid, citric acid and partial glycerides of fatty acids having carboxyl groups neutralized with alkali to a mixed ester acid number of 10 to 200 wherein a mixture of lactic acid and an alkali lactate is formed and in this mixture is esterified either in two steps or one step with the partial glycerides of fatty acids. This process can be carried out with the avoidance of the danger of saponification and also without the use of solvents.

5 Claims, No Drawings

PROCESS FOR THE MANUFACTURE OF PARTIALLY NEUTRALIZED MIXED ESTERS OF LACTIC ACID, CITRIC ACID AND PARTIAL GLYCERIDES OF FATTY ACIDS

BACKGROUND OF THE INVENTION

1. Field of the Invention

The invention relates to a process for the manufacture of mixed esters from lactic acid, citric acid and partial glycerides of fatty acids whose free carboxyl groups are neutralized with alkali to give the mixed ester an acid number of 10 to 200. The term fatty acids means an alkyl carboxylic acid with 8 to 18 carbon atoms, which may be saturated or unsaturated.*

* The term partial glycerides means mono-and/or di-esters of glycerine.

2. Description of the Prior Art

The use of esters of hydroxycarboxylic acids and partial glycerides of fatty acids for solving emulsifying and wetting problems in the fields of pharmacy, cosmetics, foods, and animal foods, is well known. At the same time, the use of hydroxycarboxylic acids, which are known to be absolutely safe physiologically, is both partly desirable and partly necessary. Such hydroxycarboxylic acids, are, for example, lactic acid and citric acid. The manufacture of such esters with a high degress of hydrophilicity however presents difficulties.

German Auslegeschrift No. 12 78 423 discloses the direct reaction of partial glycerides of fatty acids with citric acid. This process however has serious disadvantages and its applicability is therefore only limited. For example, it is possible to react at most only one mole of citric acid with one mole of the monoglyceride of a fatty acid. If the molar proportion of citric acid is increased, for the most part, it does not react and precipitates from the reaction product. If attempts are made to force the reaction by increasing the temperature, the citric acid undergoes uncontrollable decomposition which lowers the hydrophilicity of the reaction product. Because of the by-products formed, the process products no longer are absolutely safe physiologically.

It is also known that citric acid may be converted initially into an internal acid anhydride by reaction with acetic anhydride, the acetyl compound being formed at the same time and that this internal anhydride may be esterified with the partial esters of fatty acids. In this case however, one does not obtain the pure citric acid ester of the partial monoglyceride. Rather products are obtained in which the hydroxyl group of the citric acid is acetylated. When these reactions products are stored or used, acetic acid is eliminated and impairs the odor and taste of products, to which these reaction products have been added.

The object of German Patent No. 24 55 989 is a process for the manufacture of citrates of monoglycerides and/or diglycerides of fatty acids at temperatures of 100° to 140° C. The process is characterized by the fact that the reaction is carried out in the presence of amounts of acetic acid such that a clear solution is formed and is maintained during the reaction.

With this process, it has become possible to prepare citrates of partial glycerides of fatty acids with a higher degree of conversion than in the German Auslegeschrift No. 12 78 423. However, in this case it is also necessary to use acetic acid which insofar as the desired process products are concerned is extraneous.

Frequently it is desirable to increase the hydrophilicity of such esters even further, in order to influence the emulsifying action and to improve not only the solubility of the esters in cold water, but also, the so-called cold emulsifying ability. The partial or complete neutralization of the three carboxyl groups present in the esters with alkali is well known for this purpose. In this way, the pH value of the aqueous dispersion or solution is further increased and the stability of the esters in aqueous solution is improved by repressing hydroysis or saponification reactions.

A direct neutralization of the carboxyl groups of the citrate in the molten state with alkali hydroxide does not go to completion because of the partial saponification which takes place. If alkali carbonate is used, severe foaming is observed, which from a practical standpoint prevents the neutralization.

If the esters containing the three carboxyl groups are melted and mixed with aqueous solutions of alkali hydroxide or carbonate, the partial saponification can still not be avoided. Here also, foaming is quite noticeable. If the solutions are dilute, in order to check the saponification reaction, at relatively low temperatures, and especially below 40° C., the water or other solvent used must be removed again after the neutralization since the products should not be in the form of a solution for use in technical applications. Rather, they should be in solid, finely powdered form and especially in a flowable form. This is possible if a partial glyceride of a higher saturated fatty acid has been used.

Admittedly it is known to react such esters with pulverulent basic alkali salts, so as to retain the pulverulent state of the product. Such a product gives a neutral reaction after the addition of water. In any case, the high electrolyte content of such products interferes in many end use applications.

SUMMARY OF THE INVENTION

We have discovered a process which enables alkali-neutralized esters to be directly prepared from food acids and partial glycerides of fatty acids without the danger of saponification and without the use of solvents.

The process of the present invention comprises that (a) mixing 0.5 to 2 moles of alkali lactate with 0.5 to 3 moles of lactic acid relative to 1 mole of citric acid; or (b) preparing the mixture according to (a) by neutralizing lactic acid with the appropriate amounts of alkali hydroxide or alkali carbonate, after which the mixture of lactic acid and alkali lactate, obtained according to (a) or (b) is esterified either by:

($c_1$) reacting it at temperatures of 120° C. to 140° C. with citric acid and subsequently at temperatures of 120° C. to 140° C. with 0.5 moles to 2 moles of the partial glycerides of fatty acids per mole of citric acid; or ($c_2$) reacting it in one step with citric acid and 0.5 to 2 moles of the partial glycerides of fatty acids with removal of the water of reaction.

DESCRIPTION OF THE PREFERRED EMBODIMENT

A mixture of alkali lactate and lactic acid is first of all prpared in process steps (a) and (b). This can be done by mixing alkali lactate with lactic acid in the specified amounts or by neutralizing the lactic acid with such amounts of alkali hydroxide or carbonate, so that a mixture of alkali lactate and lactic acid in the desired mixing ratio is formed. If a water-containing lactic acid is used, such as, for example, the 88% commercial lactic acid, it is advisable to subsequently remove the water.

This mixture may now be esterified with citric acid and the partial glycerides of fatty acids by one of two alternative processes.

In the two-step process, the mixture of lactic acid and alkali lactate is initially reacted at temperatures of 120° to 140° C. with removal of the water of reaction by, for example, the application of a vacuum. Subsequently, this mixture, consisting of lactic acid and citric acid, is esterified with the aforementioned amounts of partial glycerides of fatty esters, the water of reaction again being removed by known procedures.

However, it is also possible to carry out the process in one step. In this case, the mixture of alkali lactate and lactic acid is directly esterified with a mixture of citric acid and the partial glycerides of fatty acids in the above-specified amounts at temperatures of 120° to 140° C. with removal of the water of reaction.

The esterification temperatures, which are between 120° and 140° C. for both processes, are limited by the fact that, at lower temperatures, the esterification reaction proceeds too slowly, and, at higher temperatures, discolorations take place in which the citric acid may be decomposed, condensed or converted to products which are not always absolutely physiologically safe.

For the process of the present invention, a partial glyceride of fatty acid is used which preferably contains at least 50 weight % of a monoester. The use of a molecularly distilled partial glyceride of fatty acid, with a monoester content of about 90 weight % is preferred.

The fatty acids of the partial glyceride may be saturated or unsaturated. When using fatty esters whose fatty acids are relatively long-chained and saturated, solid, brittle products are formed which can be sprayed to a fine, flowable powder which do not form lumps. As the content of the unsaturated fatty acids or saturated, relatively short-chained fatty acids increases, wax-like to pasty substances are formed.

The alkali content, calculated as sodium, can be varied between about 0.5 and 5.5 weight %, and the fatty acids, corresponding to the lipophilic emulsifier portion, between 26 and 60 weight %. From this it can be seen that the lipophilichydrophilic balance (HLB value) of the inventively prepared surface-active substances comprises the very wide range of about HLB 8 to HLB 14. The pH of the aqueous solutions is 2.9 to 5.5.

The inventively prepared products are dispersable or soluble in cold water.

The products of the present process are exceptionally suitable for use in pharmacy and cosmetics, as well as in foods and animal feeds. The products have a neutral odor. In general, it is unnecessary to subject the process products to any particular further treatment. However, for special applications, it is possible to treat them with activated charcoal or other substances of high adsorption capability, such as, for example, silica gel. The color of the products is bleached by such a treatment and the taste occasionally becomes more neutral.

The inventive process is explained in greater detail in the following examples. The acid number given represents the mg/KOH, which are required to neutralize the substance. The pH was measured at 22° C. in a 4% aqueous solution.

EXAMPLE 1

5.6 g of sodium lactate (0.5 moles), 90 g of lactic acid (1 mole), 192 g of citric acid (1 mole) and 800 g of 90% glycerol monostearate (2 moles) are heated with stirring for 2½ hours at 140° C. An ivory-colored, brittle, wax-like product is formed.

Acid No. = 32; pH = 5.2.

EXAMPLE 2

A solution of 64 g of potassium lactate (0.5 moles), 65 g of sodium lactate (0.5 moles) and 135 g of lactic acid (1.5 moles) are heated with 192 g of citric acid for 30 minutes under vacuum at 125° C. To the clear, syrup-like reaction mass, 400 g of molecularly distilled lard monoglyceride (1 mole) and 400 g of molecularly distilled soybean oil monoglyceride (1 mole) are added and heated for 3 hours at 135° C. The amber-colored pasty end product has an acid number of 40 and a pH of 5.1.

EXAMPLE 3

40 g of sodium hydroxide (1 mole) are reacted with 308 g of lactic acid (88%, 3 moles), reacted at 70° C. with 800 g of molten, 90% glycerol monostearate (2 moles) and 192 g of citric acid (1 mole) and then heated under vacuum to 130° C. After 4 hours, and ivory-colored, wax-like, brittle product is formed.

Acid No. = 32; pH = 5.2.

EXAMPLE 4

65 g of potassium hydroxide (86%, 1 mole) and 205 g of lactic acid (88%, 2 moles) are dehydrated under vacuum at 100° C. subsequently mixed with 940 g of a 50% glycerol monostearate (2 moles) and 192 g of citric acid (1 mole) and heated for 4 hours at 135° C. A yellowish, hard, wax-like product is formed.

Acid No. = 27; pH = 5.5

EXAMPLE 5

128 g of potassium lactate (1 mole) 90 g of lactic acid (1 mole) 400 g of 90% monostearate (1 mole) and 192 g of citric acid (1 mole) are heated for 4 hours at 130° C. The bright yellow, brittle product has an acid number of 78 and a pH of 4.2.

EXAMPLE 6

112 g of sodium lactate (1 mole), a 180 g of lactic acid (2 moles), 400 g of glycerol monostearate (1 mole) and 192 g of citric acid (1 mole) are heated for 3 hours at 140° C. A glassy, transparent, hard brittle product is formed.

Acid No. = 58; pH = 4.3.

EXAMPLE 7

60 g of sodium hydroxide (1.5 moles) are reacted with 308 g of lactic acid (88%, 3 moles) and heated with 400 g of glycerol monostearate (1 mole) and 192 g of citric acid (1 mole) for 3½ hours at 135° C. The final product has an amber-like appearance, is transparent and brittle.

Acid No. = 52; pH = 4.2.

EXAMPLE 8

256 g of potassium lactate (2 moles), 90 g of lactic acid (1 mole), 400 g of glycerol monostearate (1 mole) and 192 g of citric acid (1 mole) are heated for 2½ hours at 140° C. A shiny, ivory-colored, hard product is formed.

Acid No. = 70; pH = 4.0.

EXAMPLE 9

112 g of sodium lactate (1 mole), 180 g of lactic acid (2 moles), 384 g of citric acid (2 moles) and 400 g of glycerol monostearate (1 mole) are heated for 4½ hours at 125° C. A shiny, slightly tacky, hard product is formed.

Acid No. = 185; pH = 2.9.

EXAMPLE 10

336 g of sodium lactate (3 moles), 360 g of lactic acid (4 moles), 384 g of citric acid (2 moles) and 400 g of glycerol monostearate (1 mole) are heated for 5 hours at 120° C. A transparent, glassy, slightly tacky, amber-colored product is formed.

Acid No. = 76; pH = 5.0.

What is claimed is:

1. A process for the manufacture of mixed esters of lactic acid, citric acid and partial glycerides of tatty acids, whose carboxyl groups are neutralized with alkali to a mixed ester acid number of 10 to 200 comprising:

mixing 0.5 to 2 moles of alkali lactate with 0.5 to 3 moles of lactic acid relative to 1 mole of citric acid; and esterifying the mixture at temperatures of 120° to 140° C. with citric acid and subsequently at temperatures of 120° to 140° C. with 0.5 moles to 2 moles of the partial glycerides of fatty acids per mole of citric acid.

2. A process for the manufacture of mixed esters of lactic acid, citric acid and partial glycerides of fatty acids, whose carboxyl groups are neutralized with alkali to a mixed ester acid number of 10 to 200, comprising:

mixing 0.5 to 2 moles of alkali lactate with 0.5 to 3 moles of lactic acid relative to 1 mole of citric acid; and esterifying the mixture in one step with citric acid and 0.5 and 2 moles of the partial glycerides of fatty acids and removing the water of reaction.

3. A process for the manufacture of mixed esters of lactic acid, citric acid and partial glycerides of fatty acids, whose carboxyl groups are neutralized with alkali to a mixed ester acid number of 10 to 200 comprising:

neutralizing lactic acid with an alkali hydroxide or alkali carbonate, to obtain a mixture of lactic acid and alkali lactate; and esterifying the mixture at temperatures of 120° C. to 140° C. with citric acid and subsequently at temperatures of 120° to 140° C. with 0.5 moles to 2 moles of the partial glycerides of fatty acids per mole of citric acid.

4. A process for the manufacture of mixed esters of lactic acid, citric acid and partial glycerides of fatty acids, whose carboxyl groups are neutralized with alkali to a mixed ester acid number of 10 to 200 comprising:

neutralizing lactic acid with an alkali hydroxide or alkali carbonate, to obtain a mixture of lactic acid and alkali lactate; and esterifying the mixture in one step with citric acid and 0.5 to 2 moles of the partial glycerides of fatty acids and removing the water of reaction.

5. The process of claims 1, 2, 3, or 4, wherein a partial glyceride of a fatty acid, containing at least 50 weight % of monoester, especially about 90 weight % of monoester, is used.

* * * * *